US010882665B1

(12) United States Patent
Jiang

(10) Patent No.: US 10,882,665 B1
(45) Date of Patent: Jan. 5, 2021

(54) CHILD RESISTANT SLIDER ZIPPER

(71) Applicant: Peigen Jiang, Sammamish, WA (US)

(72) Inventor: Peigen Jiang, Sammamish, WA (US)

( * ) Notice: Subject to any disclaimer, the term of this patent is extended or adjusted under 35 U.S.C. 154(b) by 19 days.

(21) Appl. No.: 16/554,532

(22) Filed: Aug. 28, 2019

(51) Int. Cl.
*B65D 33/25* (2006.01)

(52) U.S. Cl.
CPC ..... *B65D 33/2591* (2013.01)

(58) Field of Classification Search
CPC ..... B65D 33/2591
See application file for complete search history.

(56) References Cited

U.S. PATENT DOCUMENTS 5,020,194 A * 6/1991 Herrington ..... B65D 33/2591 24/389
5,775,812 A * 7/1998 St. Phillips ..... B65D 33/2591 383/5
6,036,364 A * 3/2000 Heuvel ..... B65D 33/2591 24/399
D439,866 S * 4/2001 Savicki, Sr. ..... D11/221
6,385,818 B1 * 5/2002 Savicki, Sr. ..... B65D 33/2591 24/30.5 R
6,409,384 B1 * 6/2002 Provan ..... B65D 33/2591 24/429
6,419,391 B2 * 7/2002 Thomas ..... B65D 33/2591 383/5
6,789,947 B1 * 9/2004 Kasai ..... B65D 33/2591 24/400
7,004,631 B1 * 2/2006 Egashira ..... B65D 33/2591 383/117
7,797,802 B2 * 9/2010 Ackerman ..... B65D 33/2591 24/416
2006/0269171 A1 * 11/2006 Turvey ..... A44B 19/267 383/64
2019/0161243 A1 * 5/2019 Thompson ..... B65D 33/2591

* cited by examiner

*Primary Examiner* — Robert Sandy
*Assistant Examiner* — David M Upchurch

(57) ABSTRACT

A plastic slider zipper is disclosed which includes a pair of plastic zipper strips with ends melted together to form an end piece with a predetermined thickness, a slider slidably engaging the pair of plastic zipper strips with two side walls and a plow, a first gap between the two side walls near a first end of the slider being small enough to squeeze the zipper strips into an interlocking position, the plow located between the two side walls being able to separate the interlocked zipper strips, a top of the slider having an opening near a second end of the slider, the second end being opposite to the first end, and a fork-like part removably inserted in the opening, the fork-like part having two columns with a space therebetween approximately matching the predetermined thickness for the two columns to straddle the end piece.

20 Claims, 2 Drawing Sheets

CHILD RESISTANT SLIDER ZIPPER

BACKGROUND

The present disclosure relates generally to the field of zippers, and, more particularly, to a zipper with a child resistant slider for a plastic bag.

Plastic bags are widely used for storage of food and household items. It is desirable to keep certain food and chemicals not accessible by a child. Most plastic bags come with a slider zipper, but they generally do not have locking mechanism. Even though some slider zippers do have locking mechanisms, they tend not to be easy to use by adults. As such what is needed is a child resistant slider zipper that is easy to use by an adult.

Figure 1:
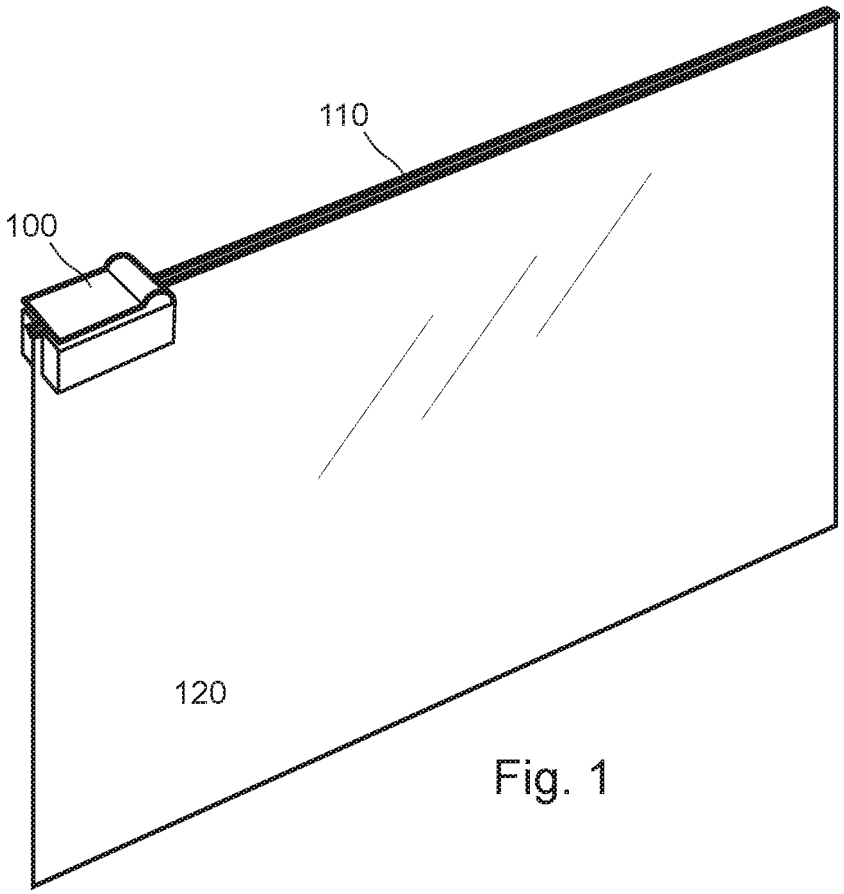
FIG. 1 illustrates a plastic bag having a child resistant slider zipper in accordance with an embodiment of the present disclosure.

The drawings accompanying and forming part of this specification are included to depict certain aspects of the disclosure. A clearer conception of the disclosure, and of the components and operation of systems provided with the disclosure, will become more readily apparent by referring to the exemplary, and therefore non-limiting, embodiments illustrated in the drawings, wherein like reference numbers (if they occur in more than one view) designate the same elements. The disclosure may be better understood by reference to one or more of these drawings in combination with the description presented herein.

DESCRIPTION

The present disclosure relates to a plastic bag with a child resistant slider zipper. A preferred embodiment of the present disclosure will be described hereinafter with reference to the attached drawings.

FIG. 1 illustrates a plastic bag 120 having a child resistant slider zipper 110 in accordance with an embodiment of the present disclosure. When a slider 100 is located at a first end of the zipper 110, the zipper 110 is closed. The zipper 110 can be opened by sliding the slider 100 toward an opposite end of the zipper 100. In order to prevent a small child from opening the zipper 110, the slider 100 has a locking mechanism according the embodiment of the present disclosure, which will be described hereinafter.

Figure 2:
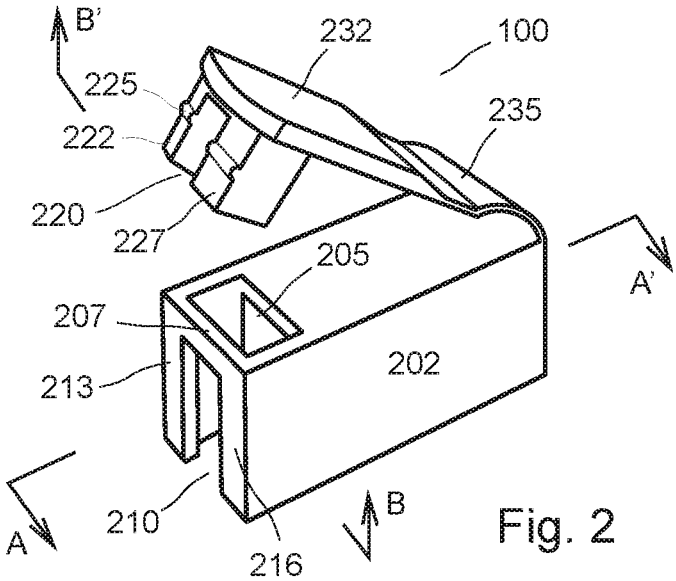
FIG. 2 is a perspective view of the child resistant slider of FIG. 1.

FIG. 2 is a perspective view of the child resistant slider 100 of FIG. 1. The slider 100 includes a slider body 202 and a tap tab 232. The slider body 202 contains a structure (not shown) that closes and opens the zipper 110. The tap tab 232 is connected to the slider body 202 through a flexible member 235 which allows the tab 232 to move away or toward the slider body 202. In an embodiment as shown in FIG. 2, the flexible member 235 is secured to a first end of the slider body 202, and the tab 232 can make a swing motion around the first end of the slider body 202. As shown in FIG. 2, there is a fork-like part 220 formed by two columns 222 and 227 attached to the tab 232. When the tab 232 swings toward the slider body 202, the fork-like part 220 can be inserted in an opening 205 on a top near a second end of the slider body 202. The second end is opposite to the first end of the slider body 202. When the fork-like part 220 is inserted in the opening 205 while the slider 100 is at the first end of the zipper 110, i.e., the zipper 110 is closed, the slider 100 is locked in place, so that the zipper 110 remain closed. When the fork-like part 220 is pulled out of the opening 205, the slider 100 is free to move away from the first end of the zipper 110 to open the zipper 110. Without the fork-like part 220 inserted in the opening 205, the slider 100 can slide in either directions to either open or close the zipper 110.

To facilitate the pull-out of the fork-like part 220, the tab 232 is made wider than the slider body 202. Alternatively, the tab 232's front may have an overhang portion beyond slider body 202, so that a user's fingers can grab on the tab 232.

As shown in FIG. 2, in an embodiment, a front of the fork-like part 220 has a convex member 225 which snaps into a concave space (not shown) in the slider body 202, so that the fork-like part 220 is firmly engaged with the slider body 202 to prevent a young child to pull it out of the slider body 202. Alternatively, the dimensions of the opening 205 and the fork-like part 220 can be made tightly matched, so that fictions therebetween can prevent their easy disengagement.

Figure 3A:
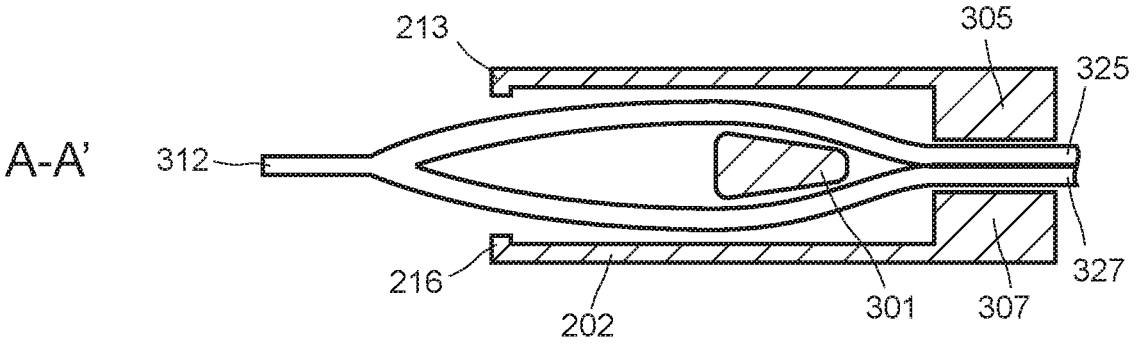
FIGS. 3A and 3B are cross-sectional view of the child resistant slider zipper of FIG. 1 at work.
Figure 3B:
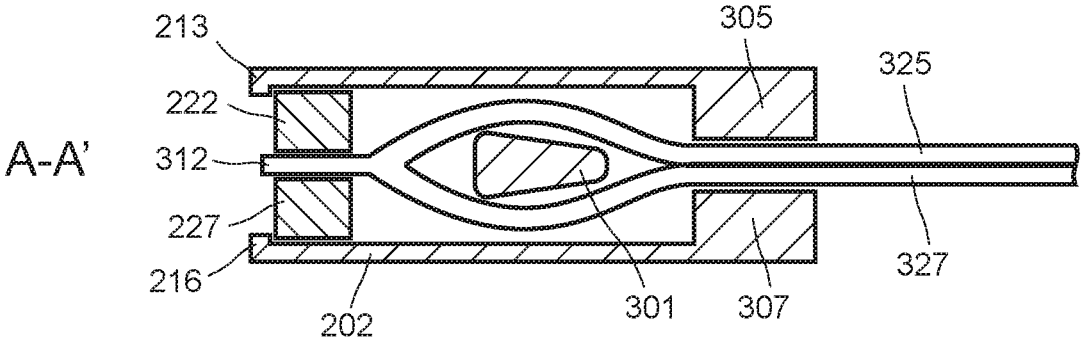

FIGS. 3A and 3B are cross-sectional view of the child resistant slider zipper 110 of FIG. 1 at work. The cross-sections are horizontally taken at location A-A' on FIG. 2 so that an internal structure of the slider body 202 is revealed. Referring to FIG. 3A, the slider body 202 has a hollow section with a plow 301 located in the middle thereof. Side walls 305 and 307 at the first end of the slider body 202 is thicker than side walls 213 and 216 at the second end of the slider body 202 so that the gap at the first end is smaller than the gap at the second end of the slider body 202. As a result, when the slider body 202 slides from the right-hand side to the left-hand side, the small gap at the first end will squeeze the zipper strips 325 and 327 together to interlock them. When the slider body 202 slides from the left-hand side to the right-hand side, the plow 301 will separate the zipper strips 325 and 327, and the large gap at the second end of the slider body 202 will leave the zipper strips 325 and 327 separated.

In an embodiment, the zipper strips 325 and 327 can employ a male-and-female type interlocking structure. For instance, the zipper strip 325 has a groove running through its length; and the zipper strip 327 has a convex member also runs through its length. The convex member can be snapped into the groove to be interlocked when the two strips 325 and 327 are squeezed together. The groove and the convex member can be pulled apart by the plow 301.

Referring to FIG. 3A again, as the zipper strips 325 and 327 are made from a plastic material, they can be melted together to form an end piece 312 with a predetermined thickness, which is thinner preferably than the thickness of the individual zipper strip 325 or 327. In an embodiment, the end piece 312 is approximately 3 millimeters long to provide enough strength to join the zipper strips 325 and 327.

Referring to FIG. 3B, the slider body 202 is located near the end piece 312, and the fork-like part 220 is inserted in the opening 205 with the columns 222 and 227 straddling the end piece 312. A space between the columns 222 and 227 approximately matches the thickness of the end piece 312, so that the end piece 312 tightly fits into the space. Besides, the columns 222 and 227 are close enough to the plow 301 so that the outwardly curved zipper strips 325 and 327 block the column 222 and 227 to move toward the right. Note that the columns 222 and 227 are secured to the slider body 202 through the opening 205, so that in this case the slider body 202 also cannot slide to the right. The slider body 202 can be unlocked by pulling the fork-like part 220 out of the opening 205 as shown in FIGS. 2 and 3A. Alternatively, as shown in FIG. 3B, the column 222 and 227 can also be secured horizontally by portions 213 and 216 protruding from the side walls of the slider body 202, respectively.

Referring to FIG. 3B again, to effectively lock the slider body 202 to the zipper 110, the columns 222 and 227 should be as close to the plow 301 as possible. Their separation should be able accommodate the bending of the zipper strips 325 and 327 but not more. In an embodiment, a distance between the column 222 or 227 and the plow 301 is approximately 3 millimeters.

Figure 4:
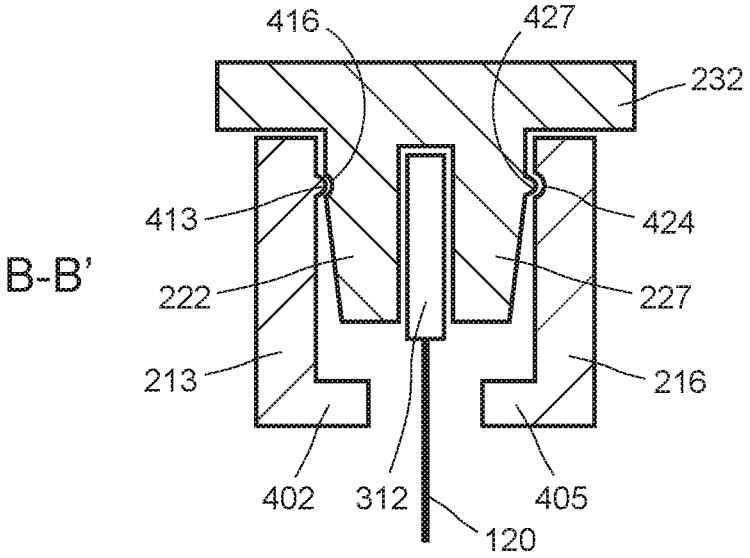
FIG. 4 is another cross-sectional view of the child resistant slider zipper of FIG. 1.

FIG. 4 is a cross-sectional view of the child resistant slider zipper 110 taken at location B-B' of FIG. 2. As shown in FIG. 4, the columns 222 and 227 are of one piece of material extended from the tab 232, and are inserted in the opening 205 of the slider body 202 defined by the walls 213 and 216. As a result, the columns 222 and 227 snuggly straddles the end piece 312 which is connected to the plastic bag 120. As shown in FIG. 4, the columns 222 and 227 are tapered with their bottom cross-sectional area smaller than that of the top, so that the fork-like part 220 can be easily inserted in the opening 205. In addition, the column 222 has a concave space 416 to accommodate a convex member 413 on an internal surface of the side wall 213. At the same time, the column 227 has a convex member 427 to snap in a concave space 424 on an internal surface of the side wall 216. Alternatively, the columns 222 and 227 have symmetrical structures, i.e., concave spaces on both columns 222 and 227 corresponding to convex members on the side walls 213 and 216, respectively, or vice versa.

As shown in FIG. 4, the side walls 213 and 216 each has a "L" shaped contour with a bottom piece 402 and 405, respectively, to narrow the bottom opening of the slider body 202. A purpose for such narrowing is to keep the slider body 202 always engaging the zipper strips 325 and 327 while sliding.

As shown in FIG. 4, the tab 232 is wider than the slider body 202 defined by the side walls 213 and 216. It is desirable that the entire slider 100 including the slider body 202, the fork-like part 220, the tab 232 and the flexible member 235 are formed by one plastic injection.

Although the disclosure is illustrated and described herein as embodied in one or more specific examples, it is nevertheless not intended to be limited to the details shown, since various modifications and structural changes may be made therein without departing from the spirit of the disclosure and within the scope and range of equivalents of the claims. Accordingly, it is appropriate that the appended claims be construed broadly and in a manner consistent with the scope of the disclosure, as set forth in the following claims.

What is claimed is:

1. A plastic slider zipper comprising:

a pair of plastic zipper strips with ends melted together to form an end piece with a predetermined thickness, the pair of plastic zipper strips being able to interlock with each other when squeezed together;

a slider slidably engaging the pair of plastic zipper strips with two side walls and a plow, the two side walls being bridged by a top member, a first gap between the two side walls near a first end of the slider being small enough to squeeze the zipper strips into an interlocking position, the plow located between the two side walls being able to separate the interlocked zipper strips, the top member having an opening near a second end of the slider, the second end being opposite to the first end; and a fork-like part removably inserted in the opening, the fork-like part having two columns with a space therebetween approximately matching the predetermined thickness for the two columns to straddle the end piece.

2. The plastic slider zipper of claim 1, wherein the pair of plastic zipper strips use a male-and-female interlocking structure.

3. The plastic slider zipper of claim 1, wherein a second gap between the two side walls near the second end of the slider is wider than the first gap.

4. The plastic slider zipper of claim 1, wherein the plow is attached to the top member and located between the opening and the first end of the slider and away from the opening by a predetermined distance.

5. The plastic slider zipper of claim 4, wherein the predetermined distance is approximately 3 millimeters.

6. The plastic slider zipper of claim 1 further comprising a tab attached to the fork-like part to facilitate pulling out the fork-like part from the opening.

7. The plastic slider zipper of claim 6, wherein the tab is connected to the first end of the slider by a flexible part allowing the tab to swing therearound.

8. The plastic slider zipper of claim 7, wherein the slider, the fork-like part, the tab and the flexible part are formed by one plastic injection.

9. The plastic slider zipper of claim 6, wherein the tab has an overhanging portion over the slider for a user to grab on.

10. The plastic slider zipper of claim 1, wherein the end piece is approximately 3 millimeters long.

11. The plastic slider zipper of claim 1, wherein the two columns are tapered with bottom cross-sectional area smaller than that of the top so that the fork-like part can be easily inserted in the opening.

12. The plastic slider zipper of claim 1, wherein at least one of the two columns has a convex member that snaps into a concave space in the slider when the fork-like part is inserted in the opening.

13. The plastic slider zipper of claim 1, wherein at least one of the two columns has a concave space that accommodates a convex member of the slider when the fork-like part is inserted in the opening.

14. The plastic slider zipper of claim 1, wherein the opening is partially defined by the two side walls of the slider.

15. The plastic slider zipper of claim 1, wherein the fork-like part is horizontally retained by a protruding portion on at least one of the side walls of the slider.

16. A plastic slider zipper comprising:

a pair of plastic zipper strips with ends melted together to form an end piece with a predetermined thickness, the pair of plastic zipper strips being able to interlock with each other when squeezed together;

a slider slidably engaging the pair of plastic zipper strips with two side walls and a plow, the two side walls being bridged by a top member, a first gap between the two side walls near a first end of the slider being small enough to squeeze the zipper strips into an interlocking position, the plow located between the two side walls being able to separate the interlocked zipper strips, the top member having an opening near a second end of the slider, the second end being opposite to the first end; and a tab having a fork-like member removably inserted in the opening, the fork-like member having two columns with a space therebetween approximately matching the predetermined thickness for the two columns to straddle the end piece, the tab being flexibly attached to the first end of the slider.

17. The plastic slider zipper of claim 16, wherein the slider and the tab are formed by one plastic injection.

18. The plastic slider zipper of claim 16, wherein the tab has an overhanging portion over the slider for a user to grab on.

19. The plastic slider zipper of claim 16, wherein the two columns are tapered with bottom cross-sectional area smaller than that of the top so that the fork-like member can be easily inserted in the opening.

20. The plastic slider zipper of claim 16, wherein the opening is partially defined by the two side walls of the slider.

* * * * *